US005544410A

United States Patent [19]

Kato et al.

[11] Patent Number: 5,544,410

[45] Date of Patent: Aug. 13, 1996

[54] METHOD OF MANUFACTURING ELECTRONIC PARTS

[76] Inventors: Ikuo Kato; Kenichiro Nogi, both of c/o Taiyo Yuden Kabushiki Kaisha of 6-16-20, Ueno, Taito-ku, Tokyo, Japan

[21] Appl. No.: 219,523

[22] Filed: Mar. 29, 1994

[51] Int. Cl.[6] ..... H01F 41/06

[52] U.S. Cl. ..... 29/605; 29/608; 264/250; 264/272.19; 336/83

[58] Field of Search ..... 29/605, 606, 608; 336/83, 233; 264/250, 272.19

[56] References Cited

U.S. PATENT DOCUMENTS 4,696,100 9/1987 Yamamoto et al. ..... 29/605

FOREIGN PATENT DOCUMENTS 56-67910 6/1981 Japan .
58-48410 3/1983 Japan .

*Primary Examiner*—Carl E. Hall
*Attorney, Agent, or Firm*—Armstrong, Westerman, Hattori, McLeland & Naughton

[57] ABSTRACT

Electronic parts, such as tip inductors may be formed by molding a first molded component as a core by kneading a magnetic material, such as ferrite powder, and a binder, such as resins, spirally winding a conductive material on the periphery of the first molded component with a constant winding pitch, molding a second molded component by covering the periphery of the conductive material as well as the first molded component with a kneaded mixture of a magnetic material, such as ferrite powder, and a binder, such as resins, to form a cover component, integrally sintering both of the first molded component and the cover component, cutting the second molded component into tips of desired length, to thereby partially expose the conductive material out of both end surfaces of the second molded component. Further, terminal electrodes may be fixed to said conductive material at each of the end surfaces of the second molded component where said conductive material of said tips is partially exposed.

3 Claims, 2 Drawing Sheets

METHOD OF MANUFACTURING ELECTRONIC PARTS

BACKGROUND OF THE INVENTION

The present invention relates to electronic parts such as a tip inductor used for eliminating an electro-magnetic interference generated within signal lines of electronic equipments, and a method and device for making same.

A number of such electronic parts for noise rejection and their methods of making have been proposed in the art, as in the following examples.

As a conventional example, Japanese Patent Kokai No. 67,910/1981 discloses an inductor made by loading ferrite powder in an extruding die in which a platinum coil has been arranged, pressing and sintering the ferrite to form a coil built-in magnetic material of integrally molded structure.

As an another conventional example, Japanese Patent Kokai No. 48,410/1983 discloses a method for making an inductor which comprises winding a conductive line on the periphery of a sintered magnetic bar to arrange a roughly wound part and a densely wound part thereon alternatively and continuously, coating a conductive paste on the roughly wound part to cover the periphery of the magnetic material so as to embed the conductive line therein, sintering thus covered bar and cutting the bar at the roughly wound part to fix external electrodes.

These conventional methods described above might provide electronic parts of generally required quality. In the case of the first example, however, such inductors are made as a batch-wise single part production which is not effective. On the other hand, according to the method described in the second example, it is difficult to make inductors on a high speed production process because of its roughly and densely winding system which should complicate related facilities. Further, the sintered product has undesirable magnetic properties due to residual inner stress and an uneven periphery surface.

SUMMARY OF THE INVENTION

It is an object of this invention to provide high quality electronic parts in which a coiled conductive material is embedded orderly and densely.

Another object of this invention is to provide a simpler and easier method and device for making electronic parts.

Still another object of this invention is to provide a method and device for making electronic parts suitable to mass scale and low cost production.

These and other objects can be achieved by this invention, in which the most characteristic features are as in the following.

(1) Electronic parts such as a tip inductor comprising:

a core component consisting of a ferrite magnetic material, a conductive material spirally wound on the periphery of said core component from one long directional end thereof to the other end with a constant winding pitch, a cover component consisting of said ferrite magnetic material to cover the periphery of said conductive material as well as said core component, and terminal electrodes fixed to both end surfaces of said core component and said cover component so as to be conductively connected to said conductive material, said core component consisting of said ferrite magnetic material and said cover component consisting of said ferrite magnetic material being integrally sintered.

(2) A method for making electronic parts such as a tip inductor comprising:

a step to mold the first molded component in a shape of a core by kneading a magnetic material such as ferrite powder and a binder, such as resins, a step to spirally wind a conductive material on the periphery of said first molded component with a constant winding pitch, a step to mold the second molded component by covering the periphery of said conductive material as well as said first molded component with a kneaded mixture of a magnetic material such as ferrite powder and a binder such as resins to form a cover component, a step to integrally sinter both of said ferrite magnetic material of said first molded component and said cover component, a step to cut said second molded component into tips of desired length, said conductive material thereby being partially exposed out of both end surfaces thereof, and a step to connectively fix terminal electrodes to each of conductive material the end surface of the where said conductive material of said tips is partially exposed.

(3) A device for making electronic parts such as a tip inductor comprising:

the first molding means to form the first molded component in a shape of core by kneading a magnetic material such as ferrite powder and a binder such as resins, a winding means to spirally wind conductive material on the periphery of said first molded component formed by said first molding means, and the second molding means to form a cover component on the periphery of said conductive material as well as said first molded component.

The functions of this invention are as follows.

(1) As the core component comprising a ferrite magnetic magnetic material and the covering component comprising the ferrite magnetic material are integrally sintered and the conductive material is spirally wound inside thereof from one long directional edge to the other one with with a constant pitch, it is possible to high quality electronic parts such as a tip inductor which internal stress is uniform and low along the long direction.

(2) It is also possible to make high quality electronic parts such as a tip inductor in which a desired magnetic property can be obtained depending on a cut length thereof.

(3) In addition, a mass scale production of high quality electric parts such as a tip inductor can be carried out effectively at high speed. As a result of these functions of this invention, there are provided high quality electronic parts in which the spiral conductive material is embedded tidily and densely in the magnetic material while keepping a homogeneous relative arrangement of each material. From a view point of production, only the extraction molding means and the conductive material supplying means are essential to the device of this invention, and any specific skill is not required to carry out each step thereof because of its highly simplified procedure. This should make a considerable contribution to an effective production of such electronic parts on mass scale at lower cost.

PREFERRED EMBODIMENTS OF THE INVENTION

Referring is now made to embodiments of the invention.

EXAMPLE 1

Figure 1:
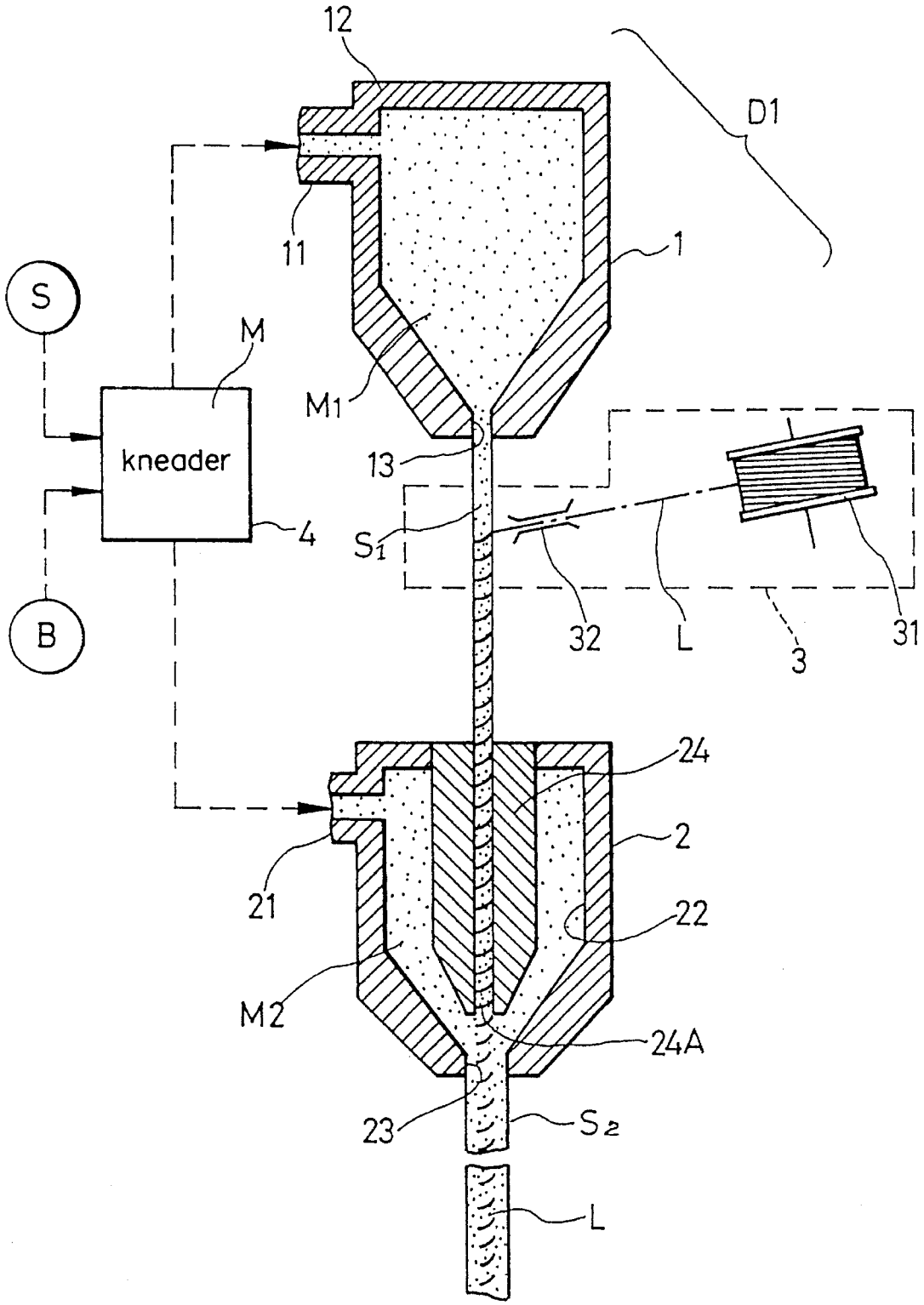
FIG. 1 is a schematic view of the present device of Example 1.
Figure 2:
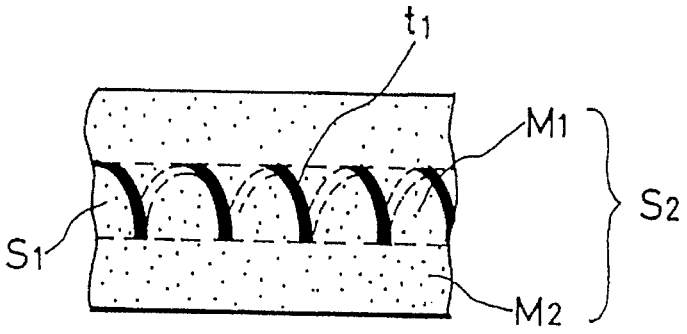
FIG. 2 is a partially cutaway side view of the second molded component formed by means of the device shown in FIG. 1.
Figure 3:
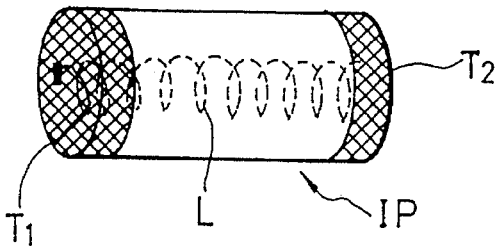
FIG. 3 is a perspective view of a tip inductor made according to Example 1.

FIG. 1 shows a device for making electronic parts as a schematic view in this example. Concerning a device (D1), an extruder die (22) of the second extruder (2) is coaxially arranged toward downstream of an another extruder die (12) of the first extruder (1) as the first molding means. A winder (3) as a conductive line (L) fitting means is arranged between the first extruder die (12) and the second extruder die (22). The first and the second extruder dies (12) and (22) are respectively connected to extruding screw built-in main bodies (not shown) of the first and second extruders (1) and (2), through supply ports (11) and (21). Delivery ends (13) and (23) are arranged at each bottom of the first and the second extruder (1) and (2), respectively. A cylindrical guide (24) is arranged in the second extruder die (22) and extended downward close to the delivery end (23).

The winder (3) comprises a supply drum (31) for supplying the conductive line (L) as the conductive material, a cylindrical or tubular line guide (32) for guiding the conductive line (L) supplied from the drum (31), a supporting means (not shown) such as bearings for rotatably supporting the drum (31) and the guide (32) around the coax and a drive means (not shown) such as a motor for rotating the drum (32) and the guide (32).

A production procedure by use of the production device (D1) is now described in the following. A ferrite magnetic material (M) is prepared by kneading a magnetic powdery mass, such as ferrite powder, and binder, such as resins in a kneader (4), which is then supplied to the first extruder die (12) under pressure through the supply port (11) by means of the built in extruding screw in the main body of the first extruder (1) and extruded from the delivery end (13) as a core material (M1) to form the first-molded component (S1). The conductive line (L) stored in the supply drum (31) of the winder (3) is introduced to the first molded component (S1) through the guide (32) and wound thereon by means of the supporting and rotary drive means with a predetermined winding pitch. The first molded component (S1) thus wound is then supplied to the cylindrical guide (24) of the second extruder die (22). The periphery of the component (S1) is covered with a cover component (M2) similarly supplied under pressure from the main body of the second extruder (2) by means of the extruding screw through the supply port (23), which is then extrusion molded from the delivery end (23) as a covered component and hardened, if necessary, by means such as a heater or drier to form the second molded component (S2).

The winding pitch of the conductive line (L) may be set to an arbitrary rate by controlling the rotation speed of the extruding screw of the first extruder (1) and/or that of the rotary drive means by use of a regulator such as inverter or speed regulator.

A typical method for making the electrical parts of this invention is described in the following.

Magnetic powdery mass (S) used herein is a ferrite material of high permeability, for example, soft ferrite powder such as Ni ferrite, Ni—Zn ferrite, Ni—Zn—Cu ferrite and Mn—Zn ferrite. A binder includes polyvinyl alcohol, ethylene cellulose, epoxy resin, ABS resin and the like. A ferrite material, a binder and a solvent such as water are kneaded in an adequate weight percent and molded by means of extruding to form the first molded component (S1) of core shape. If necessary, the component (S1) may be heated to a temperature of 80° C. to 300° C. to promote hardening thereof, although it may also be allowed to stand so as to harded at room temperature. The first molded component (S1) may be shaped arbitrarily into any contour such as round, square and the like by selecting a shape of extruder dies.

A conductive line (L) as the conductive material is then wound around the periphery of the first molded component (S1) with a constant winding pitch. A material of the conductive line (L) is arbitrarily selected from the group consisted of Pt, Ag, Ag—Pd, Cu, etc. depending on a sintering atmosphere of the ferrite magnetic material (M) and electrical properties such as electrical resistance required to the electronic parts including aninductor. The melting point of the conductive material should be higher than the sintering temperature of the ferrite-magnetic material.

On the other hand, a line diameter, winding pitch and winding number may be selected arbitrarily depending on electrical properties such as current capacity, impedance, inductance and the like which is required to the electronic parts including an inductor. It is desirable to select a diameter and introducing tension of of the conductive line (L) depending onmechanical strength of the first molded component (S1), although the diameter should preferably be in a range of several micron m to several hundred microns. In order to considerably decrease in an impact to the first molded component due to the line winding, the winding pitch should preferably be constant to the long direction, thereby break of the molded component is prevented and thus a high speed winding as well as an effective production can be effected.

In the next step, the periphery of the molded component (S1) wound with the conductive line (L) constantly to the long direction is covered with the cover component (M2) comprising the same magnetic material (M) to form the second molded component (S2). Although the cover component maybe molded by extrusion molding, spraying, transfer molding, dip-pickup process and the like, the extrusion is the best in this case from stand points of its dimensional accuracy, molding density, adhesion to the first-molded component (S1), productivity and other related factors.

The second molded component (S2) is preliminarily cut into longer pieces and orientated in a sintering sheath to sinter so as to form an integrally sintered material consisted of the first molded component (S1) and the cover component (M2). The sintering may be carried out in an adequate temperature ranging from 800° C. to 1200° C. depending on a type of ferrite magnetic material. Concerning the sintering environment, Ni, Ni—Zn, Ni—Zn—Cu ferrite or the like are preferably treated under an atmospheric condition, while a nitrogen atmosphere is preferable for Mn—Zn ferrite.

The second molded component (S2) thus sintered is further cut into tips of desired length, thereby the conductive line is exposed out of both end surfaces.

Such a cutting into desired length may be done either before or after the sintering by use of various cutting means such as leaver shears, dicing, laser beam treatment and the like.

Finally, terminal electrodes (T1) and (T2) are connectively fixed to each of the conductive line (L) on the end surfaces, where the line (L) is partially exposed, to complete the electronic parts such as a tip inductor.

When the terminal electrodes (T1) and (T2) are fixed to a tip before the sintering treatment, they can be simultaneously baked to the ferrite magnetic material during the sintering by use of a baking type paste for electrode such as Ag paste, Ag—Pd paste and Cu paste. On the other hand, when these electrodes are fixed to a tip after the sintering, or when they are fixed thereto after the sintering and then further fixed on thick film electrodes of the tip which has been sintered and baked, not only the baking type thick film process used in the above mentioned case, but thermosetting, evaporating or plating type process or the like is applicable independently or by a combination thereof. In the case of thick film process, for example, Ag paste, Ag—Pd paste or Ag mixed resin past is coated on end surfaces of a tip and baked or set at a temperature of 150° C. to 600° C. to fix the terminal electrodes.

In addition, it is preferable to further laminate a layer of Ni, Sn—Pb alloy, etc. by use of an adequate means such as plating on the terminal electrodes fixed in advance so as to improve a solderability of the electronic parts such as a tip inductor (IP) to circuit substrates.

EXAMPLE 2

Figure 4:
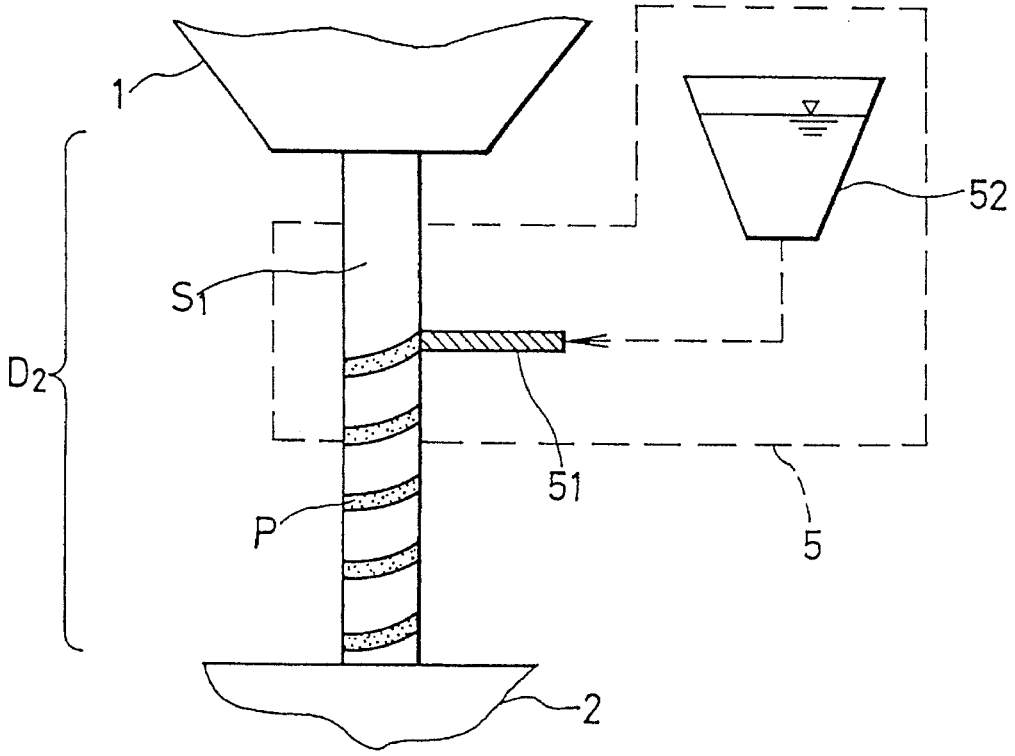
FIG. 4 is a partial schematic view of a device used in Example 2.

FIG. 4 shows a part of a device used in the present example. A difference of the present device (D2) from that of Example 1 resides in that the periphery of the first molded component (S1) is coated with a pasty conductive material by means of a coating equipment (5) to form a belt of conductive material (P). As both devices (D1) and (D2) are common except what is described above, only the difference between them will be detailed in the following.

In the present device (D2), the periphery of the first molded component (S1) is touched by a rotating paint roll (51) to spirally coat the periphery with a conductive material containing a less resistant content such as Ag—Pd, thereby a conductive belt is formed thereon.

The conductive layer on the periphery of the first molded component (S1) may also be formed by means of, e.g., jet spraying, and accordingly, it should be understood that the present invention is not restricted by such a coating means.

The visual shape of a tip inductor (IP) produced according to these examples is cylindrical, however, a rectangular parallelopiped product, for example, may easily be made by means of an oblong delivery end (23) of the second extruder (2), which might be achieved by only a simple design change.

What is claimed is:

1. A method for making electronic parts comprising:

molding a first molded component as a core by kneading and shaping a first magnetic material and a binder, spirally winding a conductive material on the periphery of said first molded component with a constant winding pitch, molding a cover component by covering the wound conductive material as well as said first molded component with a kneaded mixture of a second magnetic material and a binder, thereby forming a second molded component comprising said cover component and said first molded component, integrally sintering said second molded component, cutting said second molded component into tips of desired length to thereby partially expose said conductive material out of two end surfaces of said second molded component, and fixing terminal electrodes to said conductive material at each of said end surfaces of said second molded component.

2. The method of claim 1, wherein said first and second magnetic materials are ferrite powders, and said binder is a resin.

3. The method of claim 1, wherein the steps of molding the first molded component and molding the cover component are performed by extruding.

* * * * *